United States Patent [19]

Jacoby et al.

[11] 4,088,229

[45] May 9, 1978

[54] STORAGE RACK COLUMNS HAVING CLEAN-OUTS

[75] Inventors: Peter H. Jacoby, Perkasie; Carl Gary Seiz, Hatfield; Robert J. Egner, Dublin, all of Pa.

[73] Assignee: Seiz Corporation, Perkasie, Pa.

[21] Appl. No.: 625,533

[22] Filed: Oct. 24, 1975

[51] Int. Cl.[2] ..... A47B 57/04

[52] U.S. Cl. ..... 211/191; 248/188.8; 211/183

[58] Field of Search ..... 211/176, 177, 182, 183, 211/148, 86, 189–192; 248/188.8, 188.9, 357, 24; 16/42; 280/150.5

[56] References Cited

U.S. PATENT DOCUMENTS

| | | | |
|---|---|---|---|
| 2,006,502 | 7/1935 | Hallowell | 248/188.8 X |
| 2,301,420 | 11/1942 | Liabastre | 248/188.9 |
| 2,322,946 | 6/1943 | Liabastre | 248/188.8 X |
| 2,971,658 | 2/1961 | D'Altrui | 211/176 |
| 3,386,591 | 6/1968 | Cassel | 211/183 |
| 3,520,507 | 7/1970 | Strong | 248/188.9 X |
| 3,624,780 | 11/1971 | Elliott et al. | 211/183 X |

FOREIGN PATENT DOCUMENTS

| | | | |
|---|---|---|---|
| 818,459 | 8/1959 | United Kingdom | 211/192 |

*Primary Examiner*—Roy D. Frazier
*Assistant Examiner*—Terrell P. Lewis
*Attorney, Agent, or Firm*—Stanley B. Kita

[57] ABSTRACT

A storage rack having columns with apertures releasably mounting load support brackets is provided with clean-outs at the base of each column to enable foreign matter which enters the columns to be removed from the insides of the columns. Each column has a front flange and side flanges with bottom edges which engage a base plate. The front flange has a lower edge defining an upwardly-narrowing recess at the base of the column. A pair of gusset plates with inturned deflector flanges extend upwardly from the base plate and along the side flanges of the column. Each gusset plate has a recess in its lower edge, and weldement in each gusset plate recess secures the side flanges and the gusset plates to the base plate.

9 Claims, 10 Drawing Figures

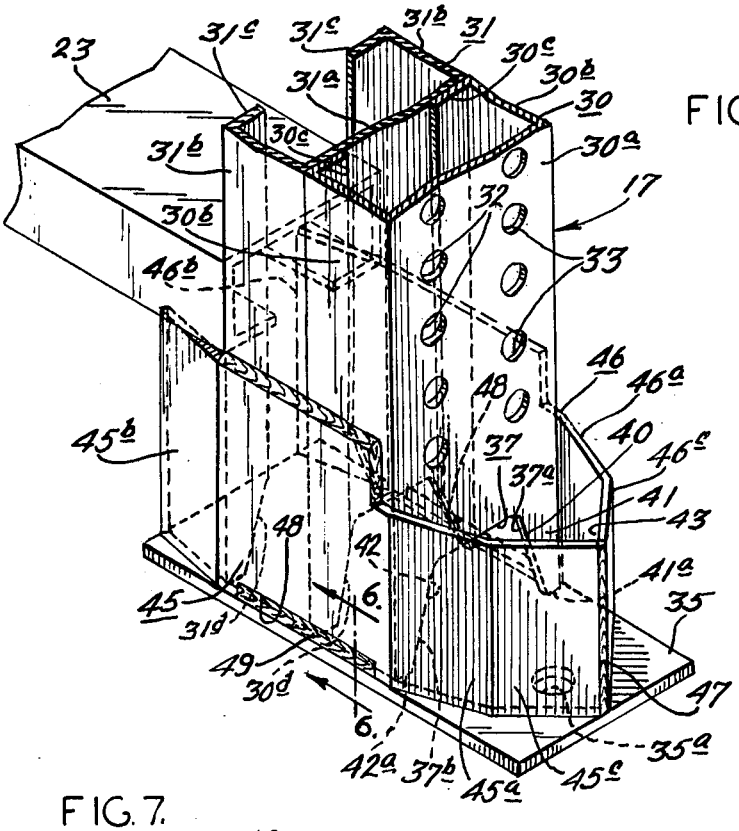
FIG. 5.
FIG. 6.
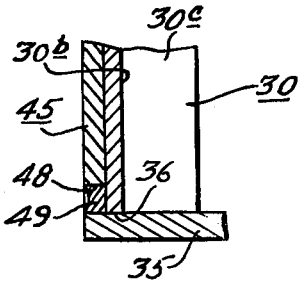
FIG. 7.
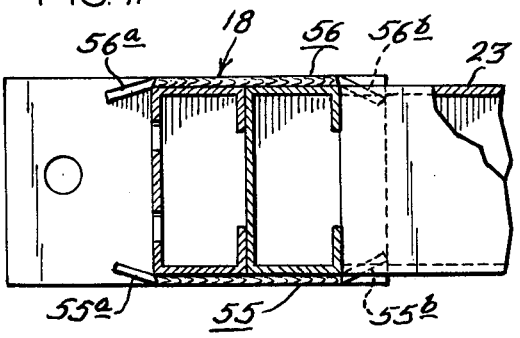
FIG. 9.
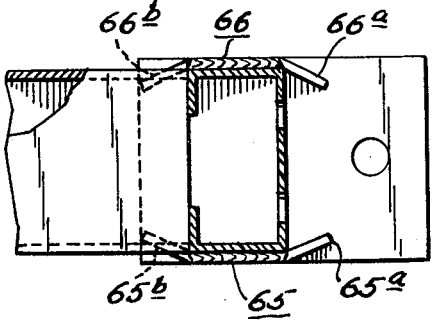
FIG. 8
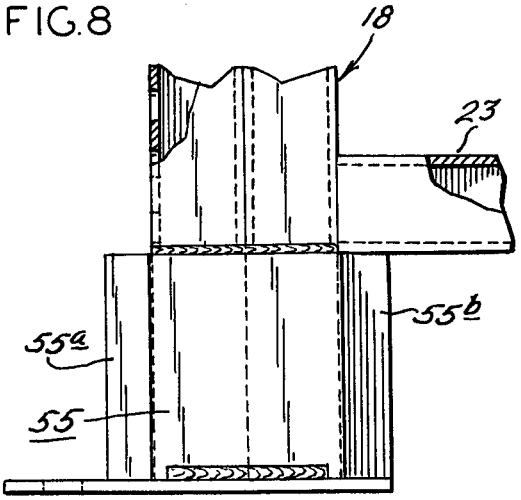
FIG. 10
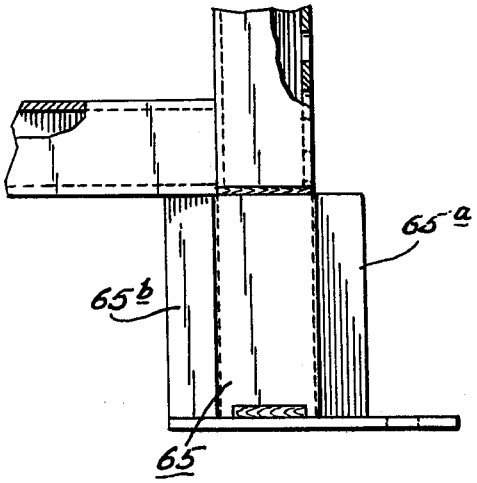

STORAGE RACK COLUMNS HAVING CLEAN-OUTS

The present invention relates to storage structures, and more particularly, the present invention relates to storage racks which can be cleaned readily.

In recent years, an increased emphasis has been placed by various governmental agencies on the cleanliness of warehouses in which food products are stored. For instance, it is not uncommon for glass food or beverage containers to be broken during handling and for the contents to be spilled onto the storage racks. The spillage is known to attract vermin which can live relatively safely from extermination by toxic sprays in certain types of storage racks. For example, storage racks which are particularly prone to inhabitation by vermin are those having vertically-adjustable load supports mounted by brackets releasably engaging vertically-spaced apertures in the columns. The spillage, dirt, dust, etc., enters the apertures and gravitates to the bottoms of the columns where it accumulates and creates an unsanitary condition. In one prior art column design, an inclined deflector is located inside the column to cause downwardly moving foreign matter to be discharged through a lateral opening in the column. Although this prevents the accumulation of foreign matter in the bottom of the column, it simply redistributes the foreign matter on the warehouse floor adjacent the column, making cleaning more difficult.

With the foregoing in mind, it is a primary object of the present invention to provide storage racks which facilitate the maintenance of high standards of cleanliness in warehouses.

It is another object of the present invention to provide storage rack columns of novel design which permit foreign matter entering apertures in the column to be removed readily from a conveniently-located clean-out near the base of the column.

A further object of the present invention is to provide a unique storage rack column which captures foreign matter in the column at a single location to facilitate the cleaning of warehouses.

Yet another object of the present invention is to provide storage rack columns which retain their full strength even though provided with bottom clean-outs.

More specifically, in the present invention a storage rack column having apertures affording the admission of foreign matter into the interior of the column above its lower end is provided with clean-out means affording removal of the foreign matter from a location adjacent the base of the column. In the illustrated embodiments, each column has an apertured front flange and side flanges, and a base plate extends across the lower end of the column. The front flange has a lower edge spaced from the base plate by compression means which cooperates with the lower edge to define a laterally-open clean-out recess at the bottom of the column. A pair of gusset plates extend upwardly from the base plate along the side flanges, and the bottom edges of the gusset plates are recessed to receive weldement which secures the lower edges of the side flanges and the gusset plates to the base plate. Preferably, the lower edge of the front flange has opposed portions which incline toward one another to define webs of increasing width in the front flange to provide the spacing means. In addition, the gusset plates have inturned flanges at least partially engaging around front and rear corners of the column and projecting upwardly beyond the upper extremity of the clean-out recess in the front flange. Selected gusset plate flanges may be provided with frontward extensions which cooperate with the base plate to define a cavity in front of the clean-out recess to afford directed flow of a cleaning medium through the clean-out recess.

These and other objects, features and advantages of the present invention should become apparent from the following description when taken in conjunction with the accompanying drawings, in which:

FIG. 5 is an enlarged fragmentary perspective view of a front column;

FIG. 6 is a greatly enlarged sectional view taken on line 6—6 of FIG. 5;

Figure 2:
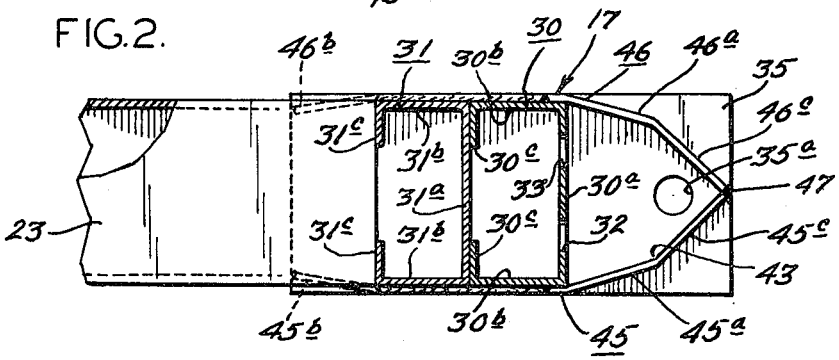
FIG. 2 is an enlarged sectional view taken on line 2—2 of FIG. 1.
Figure 3:
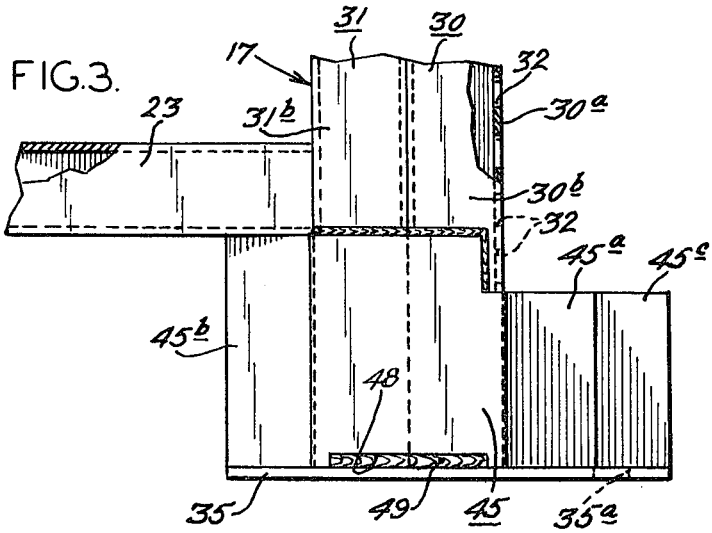
FIG. 3 is an enlarged fragmentary side elevational view of a front column.

FIGS. 7 and 8 are views similar to FIGS. 2 and 3 but illustrating double rear columns embodying the present invention; and FIGS. 9 and 10 are views similar to FIGS. 2 and 3 but illustrating single column structures embodying the present invention.

Figure 1:
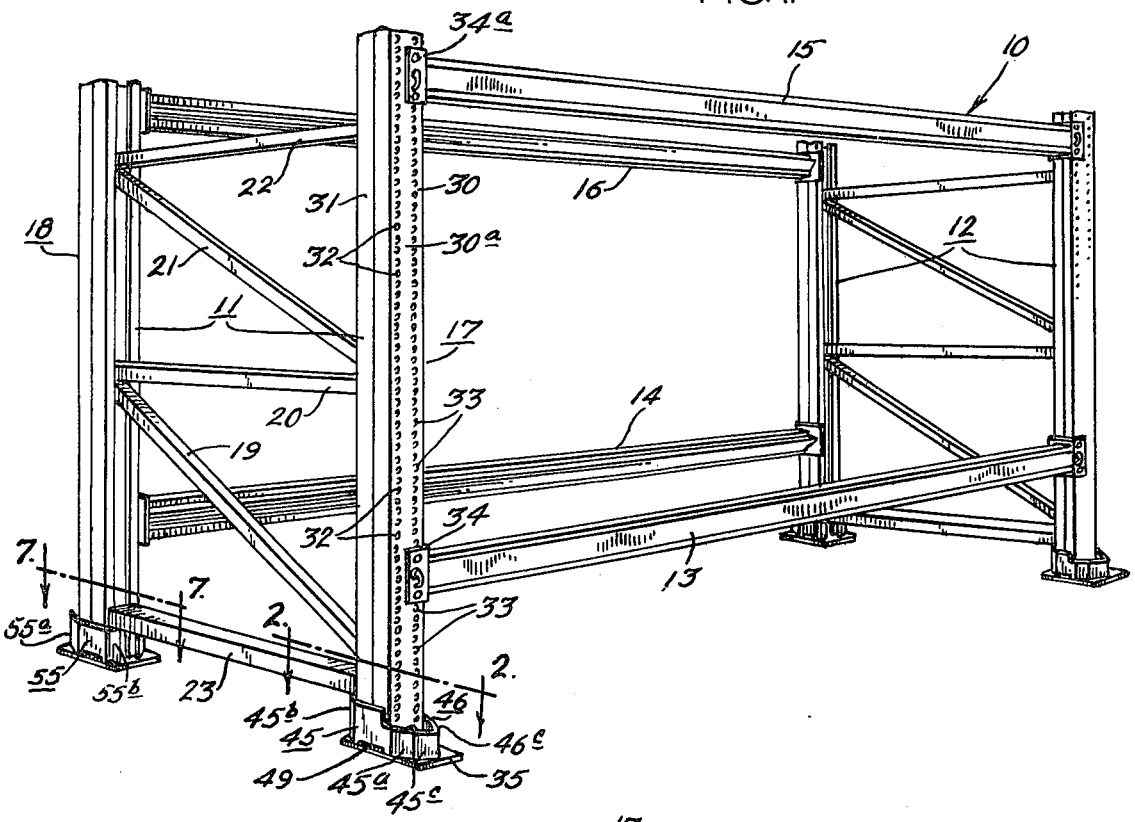
FIG. 1 is a perspective view of a storage rack having double columns embodying the present invention.

Referring now to the drawings, FIG. 1 illustrates a storage rack 10 embodying the present invention. As best seen therein, the storage rack 10 comprises a pair of end frames 11 and 12 and a plurality of load supports 13, 14, 15 and 16 spanning horizontally between the end frames 11 and 12. Each end frame, such as the left-hand frame 11, comprises a front column assembly 17 and a rear column assembly 18. Bracing struts 19, 20, 21, 22 and 23 interconnect the front and rear column assemblies 17 and 18.

Each column assembly, such as the front column assembly 17, comprises a pair of rolled steel channel members or uprights 30 and 31 (FIG. 2) and each upright, such as the front upright 30, has a front flange **30*a*, a pair of side flanges 30*b*,30*b* and inturned rear flanges 30*c*,30*c* which terminate in spaced relation with one another. The rear upright 31 of the pair has similar flanges 30*a*–31*c*, and the inturned flanges 30*c*,30*c* of the front upright 30 are welded to the front flange 31*a* of the rear upright 31. As best seen in FIG. 1, the front flange 30*a* of the front upright 30 has two rows of apertures 32 and 33 which are designed to receive the load support mounting brackets 34 and 34*a* to permit the load supports 13 and 15 to be mounted in a well-known manner at various levels in the storage rack 10**.

As described thus far, the storage rack 10 is conventional. In the rack, both rows of apertures 32 and 33 extend from top to bottom in the columns. Thus, foreign matter such as dust, dirt, spillage, vermin, etc., tends to be admitted into the interior of the columns through the apertures. When this occurs, the foreign matter tends to gravitate and collect in the bottoms of the columns.

The present invention eliminates the aforementioned drawbacks of conventional storage rack columns by providing columns with bottom clean-out structures which afford the removal of foreign matter from the interiors of the columns. To this end, a base plate 35 (FIG. 5) underlies the column assembly 17 and is engaged by the bottom edges of the side flanges, such as the bottom edge 36 of the side flange **30*b*** of the front upright 30. See FIG. 6. The front flange 30*a* of each upright, such as the front upright 30, has a horizontally-disposed lower edge 37 with portions 37*a* and 37*b* inclining upwardly toward one another from the base plate 35. The edges 37, 37*a* and 37*b* cooperate with the base plate 35 to define a generally trapezoidal-shaped clean-out opening 40 in the front flange 30*a* near the base of the column assembly 17. The edges 37*a* and 37*b* define lateral webs 41 and 42 in the front flange 30*a*, and the webs 41 and 42 increase in width in the upward direction from relatively narrow widths providing bearing surfaces 41*a* and 42*a* on the base plate 35. Thus the webs 41 and 42 space the lower edge 37 of the front flange 30*a* from the base plate 35. The bearing surfaces 41*a* and 42*a* merge with the bottom edges of the side flanges so that the webs 41 and 42 of the front flange 30*a* cooperate with the side flanges 30*b*,30*b* to stiffen the upright assembly 17 and to resist bending of the side flanges caused by side loads on the column assembly 17 near the base. It is noted that the lower portions of both of the inturned rear flanges 30*c* and 31*c* of the uprights 30 and 31 are provided with confronting edges 30*d* and 31*d*, respectively, which incline similarly to the front flange edges 37*a* and 37*b* and which are aligned therewith. See FIG. 5.

In order to deflect pallets, truck forks, etc., from the base of the column assembly 17, each column assembly is provided with a pair of deflector or gusset plates 45 and 46. As best seen in FIGS. 2–5, each gusset plate, such as the gusset plate 45, projects upwardly from the base plate 35 to a level above the level of the lower edge 37 in the front flange 30*a*. The gusset plate 45 has a front deflector flange 45*a* and a rear deflector flange 45*b*, and both flanges 45*a* and 45*b* are partially inturned around the front and rear corners of the column assembly 17 as illustrated in FIG. 2. The front deflector flanges 45*a* and 46*a* of the gusset plates 45 and 46 have extensions 45*c* and 46*c*, respectively, which taper toward one another and which intersect at a welded corner 47 located forwardly of a mounting bolt-hole 35*a* in the base plate 35 to form a cavity 43 in front of the clean-out opening 40. It is noted that the upright 31 has a clean-out opening (FIG. 5) like the opening in the upright 30, and the openings are aligned with one another. Thus, when the nozzle of a vacuum cleaner is inserted in the cavity, any foreign matter contained at the bottom of the column assembly is removed by air flowing forwardly through the clean-out openings. Of course, a stream of liquid disinfectant may be flowed under pressure into the cavity and rearwardly through the clean-out openings and the foreign matter flushed out the rear of the column assembly between the inclined lower edges 30*d* and 31*d* of the inturned rear flanges of the uprights.

Figure 4:
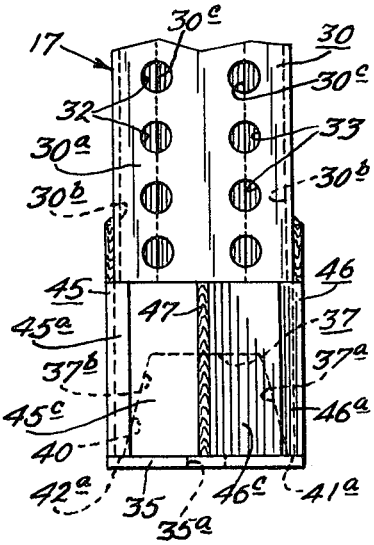
FIG. 4 is an enlarged fragmentary front elevational view of a front column.

In order to fasten the side flanges of the column assembly uprights to the base plate 35, each gusset plate, such as the gusset plate 45, has an elongated recessed lower edge 48 which extends along the side flanges 30*b* and 31*b* of the uprights 30 and 31, respectively, for a substantial portion of their extent. The recess 48 exposes the juncture of the bottom edges of the side flanges with the base plate 35 and permits the side flanges 30*b* and 31*b* to be permanently secured to the base plate 35 by weldment 49 applied in the recess. As best seen in FIG. 6, the weldment 49 also secures the gusset plate 45 to the base plate 35 without requiring the base plate to extend beyond the face of the gusset plate. Thus, the bottom configuration of the column assembly has a relatively narrow frontal profile. Preferably, the lower edges of the gusset plate 45, and its companion plate 46, are welded to the base plate 35, and the upper edges of the gusset plates are welded to the side flanges as illustrated in FIGS. 2 and 4.

The rear column assembly 18 is generally similar in construction to the front column assembly 17, except that the gusset plates 55 and 56 do not have front flange extensions. Rather, the inturned front deflector flanges 55*a* and 56*a* terminate a short distance in front of the apertured flange of the upright. See FIG. 7. Otherwise, the rear column assembly 18 is the same as the front column assembly already descirbed, including having rear deflector flanges 55*b* and 56*b*.

In light-duty racks wherein a single rolled steel upright is adequate to compose a column assembly, the structure of FIGS. 9 and 10 may be employed advantageously in lieu of the structure of FIGS. 7 and 8. In this embodiment, the gusset plates 65 and 66 are simply dimensioned shorter between their inturned front and rear flanges 65*a*–66*b* to compensate for reduced depth of the column assembly. It should be apparent, of course, that when the single upright is to be used as a front column in a storage rack, the gusset plates 65 and 66 would be modified by providing them with tapering inturned extensions as provided in the embodiment of FIGS. 2–6.

In view of the foregoing, it should be apparent that the present invention provides storage racks having column structures from which foreign matter may be removed readily to promote the cleanliness of warehouses in which they are installed while providing a high-strength rack structure.

While preferred embodiments of the present invention have been described in detail, various modifications, alterations and changes may be made in the disclosed embodiments without departing from the spirit and scope of the present invention as defined in the appended claims.

We claim:

1. In combination with a storage rack including at least one upright having flange means providing a hollow interior having a longitudinal axis, said flange means having a series of axially-spaced apertures therein for adjustably mounting load supports at various levels, the improvement comprising: a base plate extending across the bottom of said upright, means providing a lower edge on said flange means adjacent the bottom of said upright, horizontally-separated means projecting upwardly from said base plate for spacing said lower edge from said base plate and cooperating therewith to form a clean-out opening disposed transversely to said axis and affording access into the interior of said upright at the base of said upright, a pair of gusset plates extending upwardly from said base plate and engaging along said upright laterally of said clean-out opening, said gusset plates having rear flanges partially inturned around the rear of said upright and having front flanges extending frontward of said upright and tapering toward a common corner in front of said clean-out opening for cooperating with the base plate to channel the flow of cleaning medium through the clean-out opening and into and out of the interior of the upright, and means welding said gusset plates to said upright and said base plate, whereby foreign matter which may enter the interior of the upright through the apertures may be removed through the clean-out opening.

2. Apparatus according to claim 1 wherein said flange means includes a pair of side flanges with bottom edges engaged on said base plate and a front flange, said clean-out defining lower edge being located on said front flange and having opposed portions inclined upwardly toward one another from locations closely adjacent the intersection of said side flanges with said base plate to minimize the size of vertical corners formed at the intersection of the front and side flanges with the base plate.

3. In combination with a storage rack including at least one upright having flange means providing a hollow interior having a longitudinal axis, said flange means having a series of axially-spaced apertures therein or adjustably mounting load supports at various levels, the improvement comprising: a base plate extending across the bottom of said upright, means providing a lower edge on said flange means adjacent to bottom of said upright, horizontally-separated means projecting upwardly from said base plate for spacing said lower edge from said base plate and cooperating therewith to form a clean-out opening disposed transversely to said axis and affording access into the interior of said upright at the base of said upright, a pair of gusset plates extending upwardly from said base plate and engaging along said upright laterally of said clean-out opening, said flange means including a pair of side flanges with bottom edges engaged on said base plate and a front flange, said clean-out defining lower edge being located on said front flange and having opposed portions inclined upwardly toward one another from locations closely adjacent the intersection of said side flanges with said base plate to minimize the size of the vertical corners formed at the intersection of the front and side flanges with the base plate, said gusset plates having bottom edges with recesses extending along the juncture of said side flange edges with said base plate, and including weldment in said recesses securing said side flanges to said base plate and to said gusset plates, whereby foreign matter which may enter the interior of the upright through the apertures may be removed through the clean-out opening.

4. Apparatus according to claim 3 wherein said upright has front and rear vertically-disposed corners, and wherein each gusset plate has a front flange and a rear flange partially inturned around said corners and projecting upwardly to a level above said clean-out defining lower edge of said front flange.

5. Apparatus according to claim 4 wherein said gusset plates have portions extending frontward of said front flange for cooperating with said base plate to form a cavity in front of said clean-out opening to channel flow of a cleaning medium through said clean-out opening.

6. For installation in a storage rack, an upright having a front flange and side flanges with bottom edges, a base plate engaged with side flange edges, said front flange having a lower edge defining with said base plate a clean-out opening diposed transversely with respect to the longitudinal axis of the upright at the lower end of said upright, a pair of gusset plates extending upwardly from said base plate along said side flanges, each gusset plate having front and rear inturned flanges and a recess above the bottom edges of said side flanges, and weldment in said gusset plate recesses securing the side flanges along their lower edges to the base plate.

7. In combination with a storage rack, an elongated hollow upright having a longitudinal axis extending lengthwise thereof, said upright having a front flange, side flanges with bottom edges, and rear flange means behind said front flange, said front, side and rear flanges forming vertically-disposed corners, a base plate mounted across said bottom edges of said side flanges, said front flange having a lower edge extending in spaced relation with said base plate for cooperating therewith to define a clean-out opening disposed in said front flange transversely to said longitudinal axis at the lower end of said upright, and said rear flange means having edges cooperating with said base plate to define a rear clean-out opening aligned with said front clean-out opening to afford the flow of a cleaning medium transversely through the bottom of the upright along said base plate, a pair of gusset plates extending upwardly from said base plate, each gusset plate having a side flange engaging the side flange of said upright and projecting upwardly to a level above said clean-out defining lower edge of said front flange, and each gusset plate having a front flange extending frontward of said upright front flange, said gusset plate front flanges converging in front of said clean-out opening for cooperating with said base plate to channel flow of a cleaning medium into and out of said upright through said clean-out opening, and including means welding said gusset plates to said upright side flanges and said base plate, whereby foreign matter which may enter the upright through the apertures may be removed through the clean-out opening.

8. Apparatus according to claim 7 wherein each of said front and rear flanges has confronting edge portions extending upwardly toward one another from locations closely adjacent the intersections of said side flange bottom edges with said base plate to maximize the size of the clean-out opening adjacent the base plate and to minimize the size of the vertical corners formed at the intersections of the front, rear and side flanges with the base plate.

9. In combination with a storage rack, an elongated upright having a lengthwise-extending front flange and side flanges extending therealong, and means providing a base plate disposed transversely across one end of said upright, said side flanges having bottom edges engaged against said base plate and said front flange having a lower edge spaced from said base plate for cooperating therewith to define a transverse clean-out opening in said front flange, said lower edge of said front flange having confronting portions tapering toward one another from locations closely adjacent the intersections of said side flange lower edges with said base plate to provide said clean-out opening with a relatively wide dimension adjacent said base plate, a pair of gusset plates engaging the side flanges of said upright and projecting upwardly from said base plate to a level above the clean-out opening, each gusset plate having a pair of rear flanges partially inturned around the rear of the upright and each gusset plate having a pair of front flanges converging in front of said clean-out opening for cooperating with said base plate to channel the flow the cleaning medium into and out of the upright through said clean-out opening, and means welding said gusset plates to said upright side flanges and said base plate, whereby foreign matter which may enter the upright through the apertures may be removed through the clean-out opening.

* * * * *